US008050591B2

(12) United States Patent
Koido

(10) Patent No.: US 8,050,591 B2
(45) Date of Patent: Nov. 1, 2011

(54) POWDER DEVELOPER HOLDING APPARATUS, DEVELOPING APPARATUS, AND IMAGE FORMING APPARATUS

(75) Inventor: Shigenori Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 450 days.

(21) Appl. No.: 12/379,736

(22) Filed: Feb. 27, 2009

(65) Prior Publication Data

US 2009/0238609 A1 Sep. 24, 2009

(30) Foreign Application Priority Data

Mar. 19, 2008 (JP) ..... 2008-072044

(51) Int. Cl.
*G03G 15/08* (2006.01)

(52) U.S. Cl. ..... 399/106; 399/262

(58) Field of Classification Search ..... 399/106, 399/262

See application file for complete search history.

(56) References Cited

U.S. PATENT DOCUMENTS

| | | | | |
|---|---|---|---|---|
| 7,245,860 | B2 * | 7/2007 | Huang et al. | 399/262 |
| 7,421,234 | B2 * | 9/2008 | Ikeda et al. | 399/262 |
| 7,747,199 | B2 * | 6/2010 | Koido | 399/262 |
| 2006/0182469 | A1 | 8/2006 | Koyama et al. | |
| 2008/0056759 | A1 * | 3/2008 | Koido | 399/106 |

FOREIGN PATENT DOCUMENTS

| | | |
|---|---|---|
| EP | 1 895 368 A2 | 3/2008 |
| JP | 2003-050505 | 2/2003 |
| JP | 2005-173568 | 6/2005 |
| JP | 2006-235592 | 9/2006 |

* cited by examiner

*Primary Examiner* — David Gray
*Assistant Examiner* — Frederick Wenderoth
(74) *Attorney, Agent, or Firm* — Rabin & Berdo, PC

(57) ABSTRACT

A powder developer holding apparatus prevents developer leakage. A housing holds powder developer, and includes a discharging opening through which the powder developer is discharged. A shutter is mounted to the housing and is rotatable relative to the housing to an opening position where the discharging opening is opened or to a closing position where the discharging opening is closed. A locking member is slidably mounted to the shutter. When the powder developer holding apparatus is oriented such that the discharging opening faces upward in a gravitational direction, the locking member prevents the shutter from rotating relative to the chamber.

13 Claims, 10 Drawing Sheets

POWDER DEVELOPER HOLDING APPARATUS, DEVELOPING APPARATUS, AND IMAGE FORMING APPARATUS

BACKGROUND OF THE INVENTION

1. Field of the Invention

The present invention relates to a powder developer, a developing apparatus, and an image forming apparatus.

2. Description of the Related Art

Conventional image forming apparatuses include printers, copying machines, and multi-function peripherals (MFPs). For example, a printer includes image forming units. The image forming unit includes a photoconductive drum, a charging roller, and a developing unit. The charging roller uniformly charges the surface of the photoconductive drum. An LED head illuminates the charged surface of the photoconductive drum in accordance with image data to form an electrostatic latent image on the photoconductive drum. A thin layer of toner is formed on the developing roller, and the toner on the developing roller is supplied to the electrostatic latent image to form a toner image on the photoconductive drum. The toner image is then transferred by a transfer roller onto a print medium or paper. The toner image on the print medium is then fixed into a permanent image.

JP 2003-50505A discloses a printer in which a powder developer holding apparatus or a toner cartridge is detachably attached to the image forming unit. Toner is supplied from the toner cartridge into a developing unit. The toner cartridge includes a toner discharging opening formed therein, the discharging opening being opened and closed by a shutter with an operation lever. When the lever is operated to an opening position, the shutter opens the toner discharging opening such that the toner is discharged from the toner cartridge.

The toner cartridge suffers from a problem in that the shutter may be opened with the toner discharging opening facing upward, before the toner cartridge has been attached to the image forming unit. If the shutter is opened inadvertently, foreign matter (e.g., paper particles) may enter the toner cartridge.

SUMMARY OF THE INVENTION

An object of the invention is to solve the drawbacks of conventional image forming apparatuses.

Another object of the invention is to provide a developer holding apparatus in which foreign matter is prevented from entering the developer holding apparatus.

Still another object of the invention is to provide a developing unit that employs the developer holding apparatus and an image forming apparatus that employs the developing unit.

A powder developer holding apparatus is capable of preventing powder developer from leaking. A housing holds powder developer and includes a discharging opening through which the powder developer is discharged. A shutter is mounted to the housing and is rotatable relative to the housing to an opening position where the discharging opening is opened or to a closing position where the discharging opening is closed. A locking member is slidably mounted to said shutter and prevents the shutter from rotating relative to the housing when the powder developer holding apparatus is oriented such that the discharging opening faces upward in a gravitational direction.

A developing apparatus incorporates the powder developer holding apparatus of the aforementioned configuration.

An image forming apparatus incorporates the powder developer holding apparatus of the aforementioned configuration.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings. An image forming apparatus of the invention will be described in terms of a printer.

Figure 1:
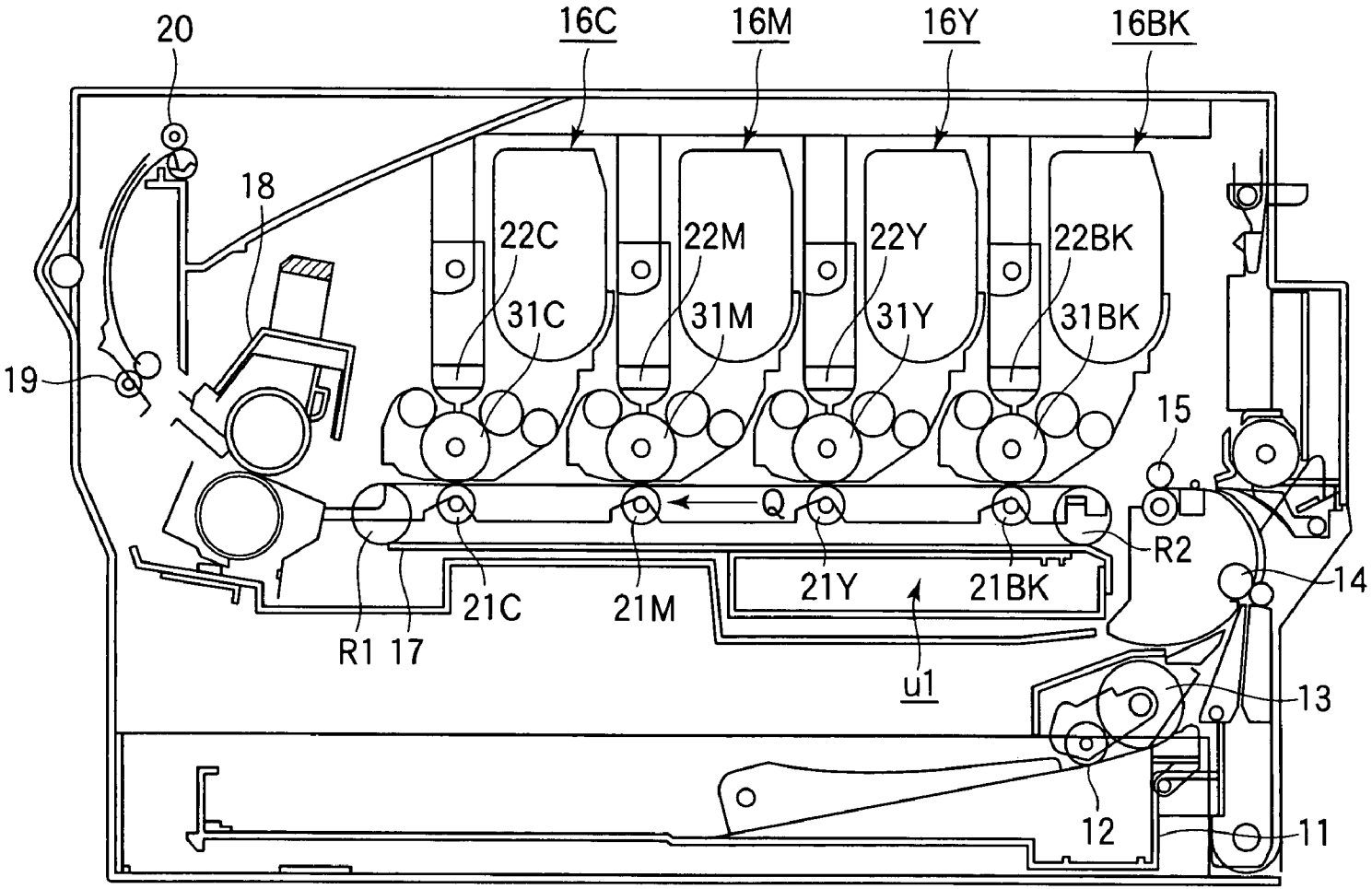
FIG. 1 illustrates the general configuration of a printer of a first embodiment.

FIG. 1 illustrates the general configuration of a printer of a first embodiment.

Referring to FIG. 1, a medium holder or a paper cassette 11 is disposed at a lower portion of the printer. The paper cassette 11 holds a stack of print media (e.g., print paper, not shown).

A paper feeding mechanism is disposed adjacent to the front end of the paper cassette 11, and includes a feed roller 12 and a separator roller 13. The paper feeding mechanism feeds the print paper on a page-by-page basis in to a transport path. The print paper is fed to a transport roller 14 and then to a transport roller 15, so that the print paper advances through image forming units (referred to as ID unit hereinafter) 16BK, 16Y, 16M, and 16C that form black, yellow, magenta, and cyan toner images, respectively.

The ID units 16BK, 16Y, 16M, and 16C include image bearing bodies or photoconductive drums 31Bk, 31Y, 31M, and 31C, respectively. Disposed around the photoconductive drums 31Bk, 31Y, 31M, and 31C are exposing units or LED heads 22BK, 22Y, 22M, and 22C, respectively, which extend in parallel to the photoconductive drums 31BK, 31Y, 31M, and 31C. The exposing units may also be a laser type exposing unit.

A transfer unit is disposed to face the ID units 16BK, 16Y, 16M, and 16C. The transfer unit includes a drive roller R1, a driven roller R2, a transport belt 17 disposed about the drive roller R1 and driven roller R2, and transfer rollers 21BK, 21Y, 21M, and 21C. The drive roller R1 drives the transport belt 17 to run. The transfer rollers 21K, 21Y, 21M, and 21C parallel the photoconductive drums 31BK, 31Y, 31M, and 31C, respectively, with the transport belt 17 sandwiched between the photoconductive drums 31BK, 31Y, 31M, and 31C and the transfer rollers 21BK, 21Y, 21M, and 21C.

The transport belt 17 runs in a direction shown by arrow Q to transport the print paper through the respective ID units 16BK, 16Y, 16M, and 16C so that the toner images of the respective colors are transferred onto the print paper in registration to form a full color toner image.

Subsequently, the print paper is advanced to a fixing unit 36 where the full color toner image is fixed into a full color permanent image. Then, the print paper is further advanced by a transport roller 19 from the fixing unit 36, and then by a discharge roller 20 onto a stacker outside of the printer.

{ID Units}

The ID units 16BK, 16Y, 16M, and 16C will be described. Each of the ID units 16BK, 16Y, 16M, and 16C may be substantially identical; for simplicity only the operation of the ID unit 16BK for forming black images will be described, it being understood that the other ID units 16BK, 16Y, 16M, and 16C may work in a similar fashion.

Figure 2:
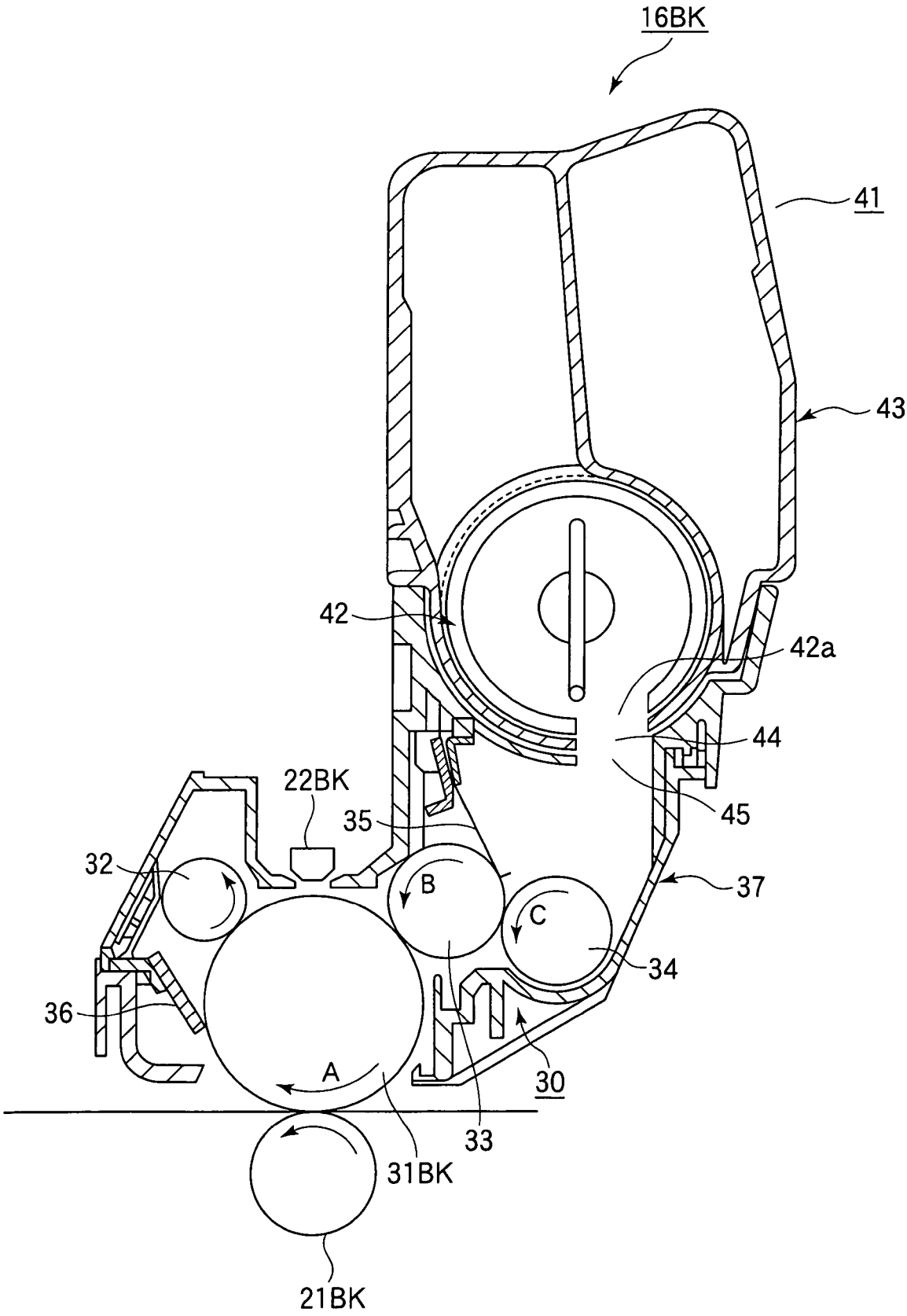
FIG. 2 is a cross-sectional view of an ID unit of the first embodiment.

FIG. 2 is a cross-sectional view of the ID unit 16BK of the first embodiment.

Referring to FIG. 2, a toner cartridge 41 is detachably attached to a body 37 of the ID unit 16BK (powder developer holding apparatus). The toner cartridge 41 holds black powder developer or toner (not shown), which is supplied into the body 37. The toner cartridge 41 includes a housing or a case 43 in which a discharging opening 44 is formed. A shutter 42 is attached into the case 43 such that the shutter 42 is slidably movable along a substantially cylindrical inner wall of the case 43 to open or close the discharging opening 44 and is rotatable about its longitudinal axis. The shutter 42 includes an opening 42*a* formed therein. When the shutter 42 is rotated such that the opening 42*a* and the discharging opening 44 overlap one another, the toner is discharged from the toner cartridge 41 into the developing unit 30. When the shutter 42 is rotated such that the opening 42*a* and the discharging opening 44 do not overlap one another, the discharging opening 44 is completely closed. FIG. 2 illustrates the shutter position when the shutter closes the discharging opening 44.

The body 37 includes a concavely cylindrical mounting surface for receiving the toner cartridge 41 thereon. The mounting surface is formed with a developer receiving opening 45 therein. The toner discharged from the toner cartridge 41 is received into the body 37 through the developer receiving opening 45.

The ID unit 16BK includes a photoconductive drum 31BK, a charging roller 32, a developing roller 33, a toner supplying roller 34, a developing blade 35, and a cleaning blade 36. The charging roller 32 uniformly charges the surface of the photoconductive drum 31BK. The toner supplying roller 34 supplies the toner to the developing roller 33. The developing blade 35 forms a thin layer of toner on the developing roller 33. The developing roller 33 holds the thin layer of toner thereon. The cleaning blade 36 removes the residual toner from the surface of the photoconductive drum 31BK.

A drive motor (not shown) drives the developing roller 33 and the toner supplying roller 34 in directions shown by arrows C and B, respectively, during printing, so that the toner is supplied from the toner supplying roller 34 to the developing roller 33. As the developing roller 33 rotates, the developing blade 35 in pressure contact with the developing roller 36 forms the thin layer of toner on the developing roller 33, removing excess toner from the developing roller 33. As the developing roller 33 further rotates, the thin layer of toner is brought into contact with the photoconductive drum 31BK.

The photoconductive drum 31BK is driven by a drive motor (not shown) to rotate in a direction shown by arrow A. The surface of the photoconductive drum 31BK is uniformly charged by the charging roller 32. The LED head 22BK illuminates the charged surface of the photoconductive drum 31BK to form an electrostatic latent image in accordance with print data. The electrostatic latent image is developed with the toner supplied from the thin layer of toner formed on the developing roller 33.

{Configuration of Toner Cartridge}

Figure 3A:
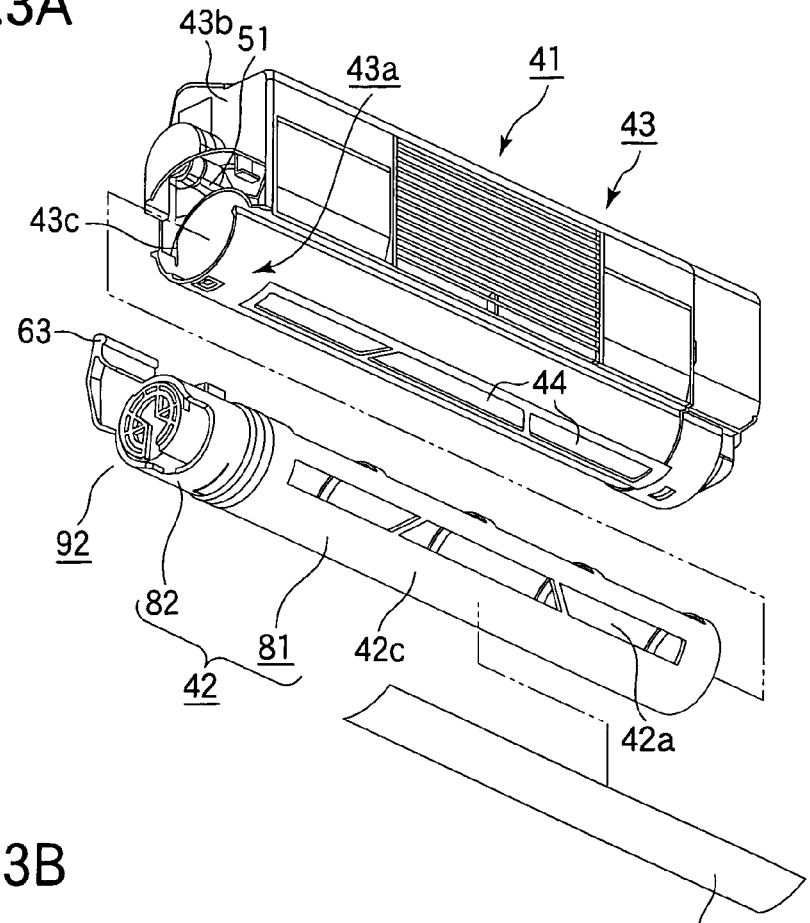
FIG. 3A is a perspective view of a toner cartridge of a first embodiment.
Figure 3B:
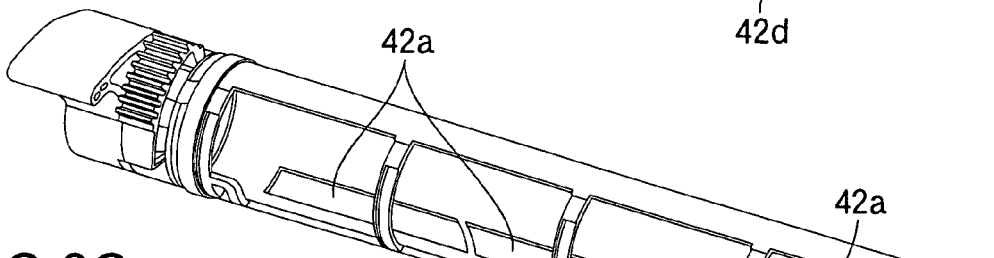
FIGS. 3B and 3C are perspective views of a shutter.
Figure 3C:
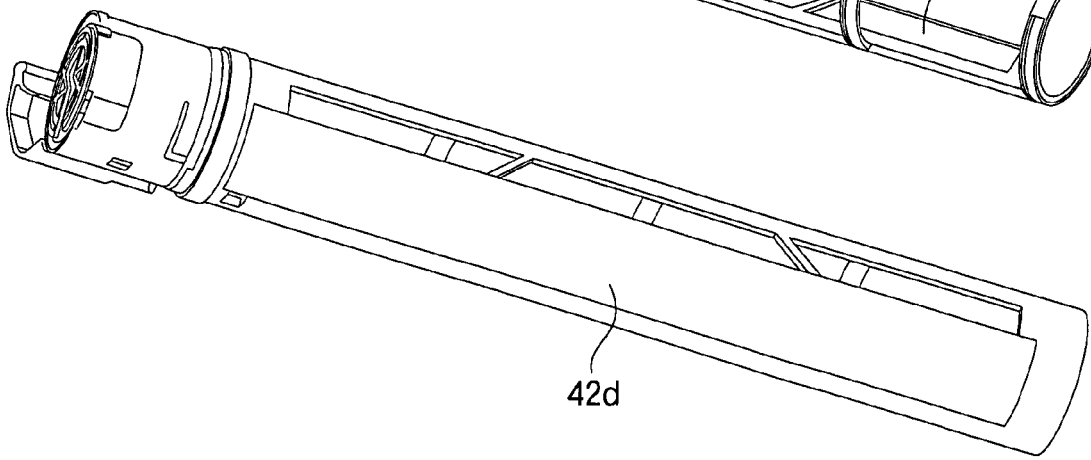
Figure 4:
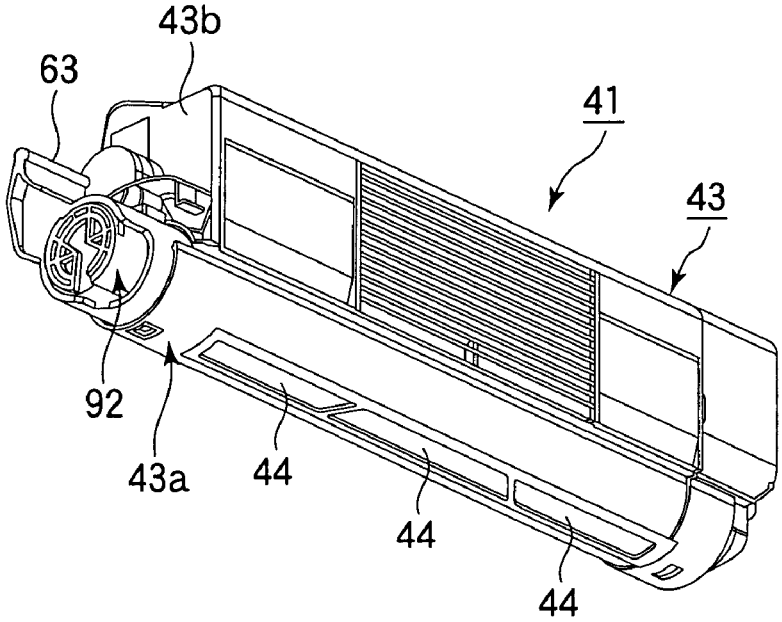
FIG. 4 illustrates the toner cartridge when an operation lever is at a closing position.

The configuration of the toner cartridge 41 will be described. FIG. 3A is a perspective exploded view of the toner cartridge 41 of the first embodiment. FIGS. 3B and 3C are perspective views of the shutter. FIG. 4 illustrates the toner cartridge 41 when an operation lever 63 is at a closing position and FIG. 5 illustrates the toner cartridge 41 when the operation lever 63 is at an opening position.

Figure 5:
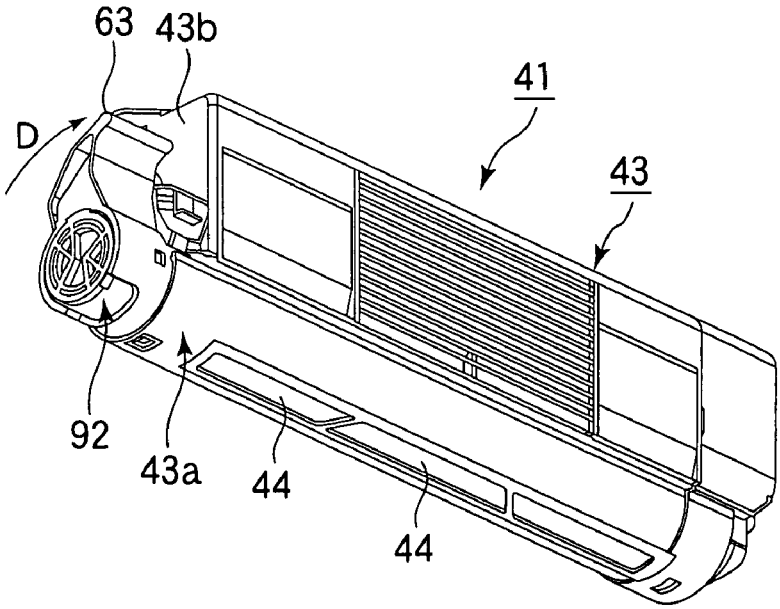
FIG. 5 illustrates the toner cartridge when the operation lever is at an opening position.

Referring to FIGS. 4 and 5, the toner cartridge 41 includes the case 43 and the shutter 42 detachably attached to the case 43. The case 43 includes a generally cylindrical lower bottom 43*a* in which the toner discharging opening 44 is formed. The shutter 42 is generally in the shape of a hollow cylinder. The shutter 42 includes a body 81, a knob 92 that fits over one end portion of the body 81 (FIG. 3A). The knob 92 includes a short cylindrical portion 82 that fits to the body 81 such that the shutter 42 is rotatable together with the knob 92 relative to the body 81. The knob 92 includes the operation lever 63 that extends radially from the knob 92. The knob 92 also includes three radial projections (FIGS. 6-9). The body 81 includes a shutter portion 42*c* that closes the discharging opening 44 and an opening 42*a* that opens the discharging opening 44. The body 81 also includes three recesses to which the three radial projections of the knob 92 fits so that the knob 92 and the body 81 are unable to rotate relative to each other but are able to rotate together. The shutter portion 42*c* and opening 42*a* extend in a direction parallel to a longitudinal direction of the body 81.

A sealing member 42*d* is formed of, for example, a sponge material, and is bonded to the outer circumferential surface adjacent to the opening 42*a*. The sealing member 42*d* seals the gap between the shutter 42 and the case 43 to prevent the toner from leaking from the case 43. The operation lever 63 is in one piece with the shutter 42, and extends in a radial direction from the knob 92. The case 43 includes a side wall 43*b* from which a guide portion 43*c* projects outwardly. The guide portion 43*c* guides the shutter 42 into the case 43 when the shutter 42 is inserted into the case 43.

If the toner cartridge 41 is configured such that the shutter can be opened with the discharging opening 44 facing upward before attaching the toner cartridge 41 to the body 37, inadvertently opening the shutter 42 may allow foreign matter such as paper particles to enter the toner cartridge 41. In order to solve this drawback, the toner cartridge 41 includes a rotation limiting mechanism that is disposed between the case 43 and the shutter 42 and limits rotation of the shutter 42 relative to the toner cartridge 41. The rotation limiting mechanism includes a stopper or a projection 51 and a locking element or a pin 54. The projection 51 projects from the side wall 43*b* in the vicinity of the guide portion 43*c*. The pin 54, which will be described later, is disposed on the shutter 42. The projection 51 is substantially rectangular in the first embodiment, but may be in any shape.

The rotation limiting mechanism will be described in detail.

Figure 6:
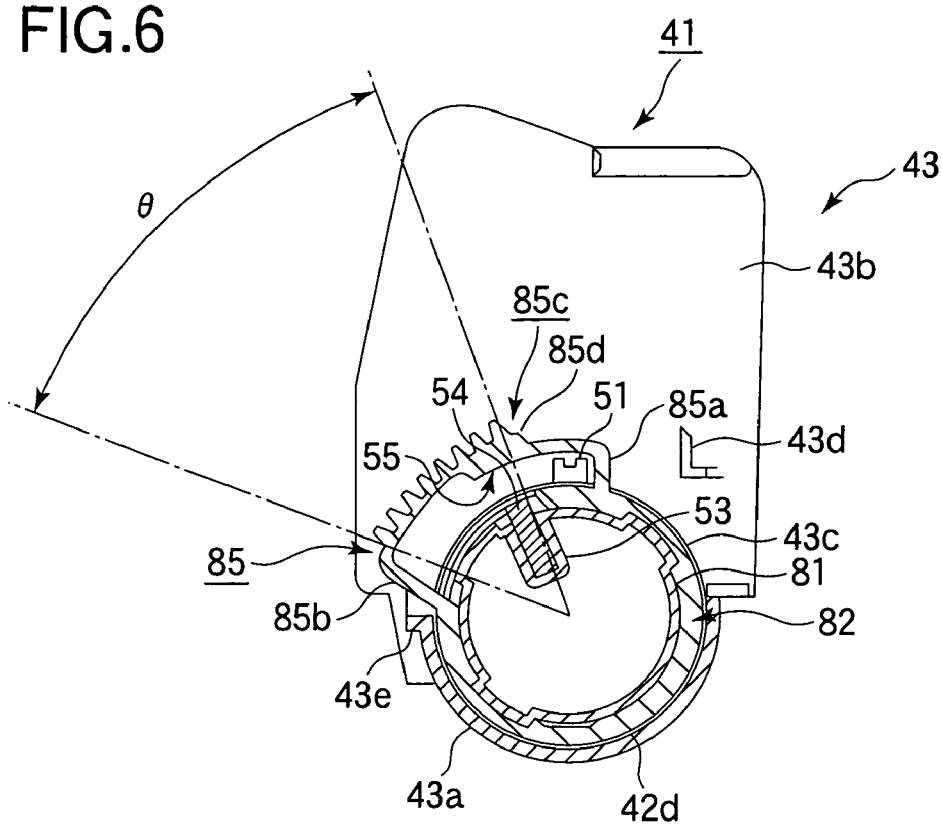
FIGS. 6 and 7 are a first cross-sectional view and a second cross-sectional view, respectively, illustrating a pertinent portion of the toner cartridge when the toner cartridge has been attached to the body of the ID unit.
Figure 7:
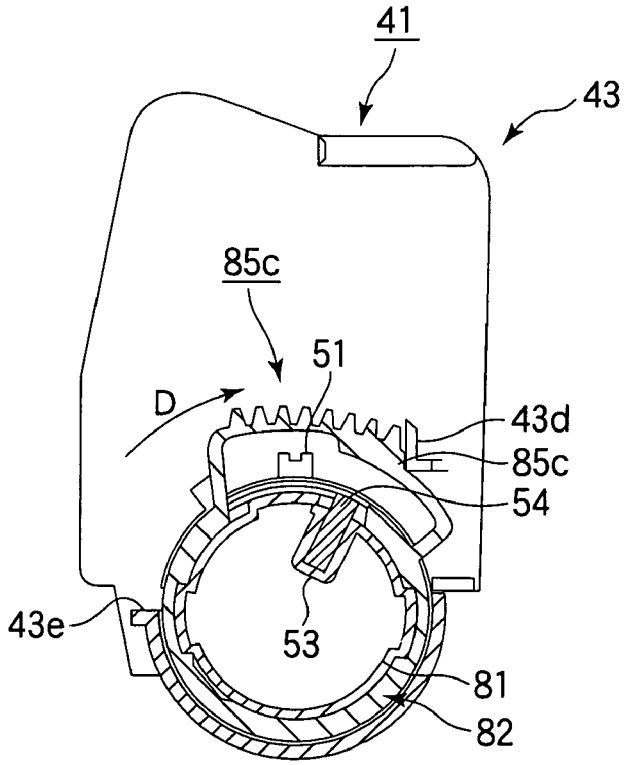
Figure 8:
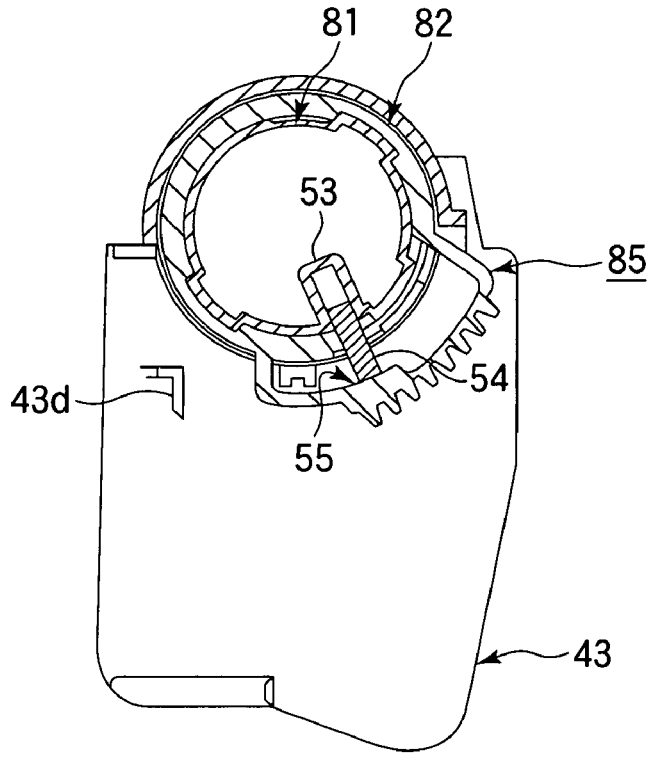
FIGS. 8 and 9 are a first cross-sectional view and a second cross-sectional view, respectively, illustrating a pertinent portion of the toner cartridge when the toner cartridge is oriented such that the discharging opening faces upward.
Figure 9:
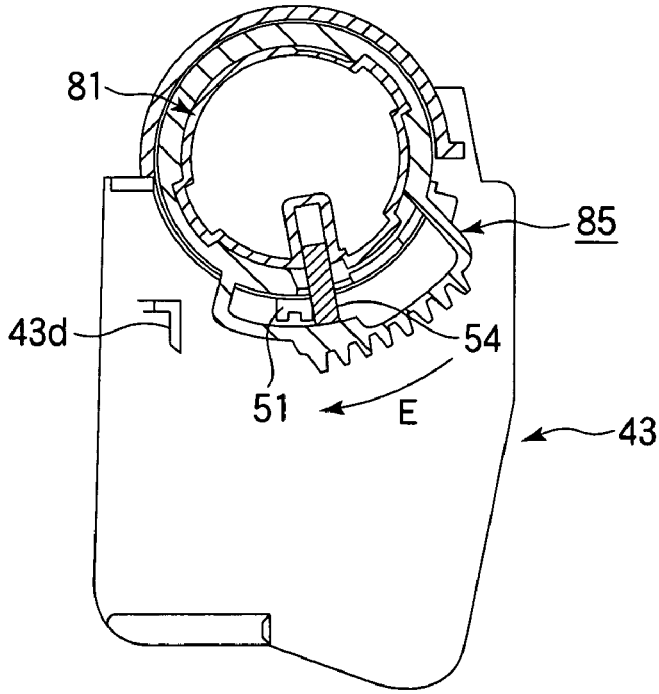

FIGS. 6 and 7 are a first cross-sectional view and a second cross-sectional view, respectively, illustrating a pertinent portion of the toner cartridge 41 when the toner cartridge 41 has been attached to the body 37. FIGS. 8 and 9 are a first cross-sectional view and a second cross-sectional view, respectively, illustrating a pertinent portion of the toner cartridge 41 when the toner cartridge 41 has been detached from the body 37.

FIGS. 6-9 illustrate the portions that project outwardly from the side wall 43*b*, and therefore do not illustrate the discharging opening 44 and opening 42*a*. FIGS. 6-9 illustrate cross-sectional views of a portion of the shutter 42 between the operation lever 63 and the side wall 43*b*, and therefore do not show the lever 63.

Referring to FIGS. 6 and 7, the case 43 includes the bottom surface 43*a* that extends in a longitudinal direction of the toner cartridge 41 and a guide portion 43*c* that projects from the side wall 43*b*.

The short cylindrical portion 82 includes a radial extension 85. Projections 85*a* and 85*b* extend from the knob 92 substantially in a radial direction. An arcuate wall 85*c* extends across the projections 85*a* and 85*b* through a predetermined angular range θ with respect to the rotational axis of the shutter 42. Referring to FIG. 6, the projection 85*a* is formed at a position substantially in a gravitational direction, and the projection 85*b* is formed at a position a predetermined angle away from the projection 85*a*. The projections 85*a* and 85*b* and the arcuate wall 85*c* cooperate to define a moveable range θ in which the shutter 42 may rotate. When the user operates the operation lever 63, the shutter 42 rotates within the movable range θ. The arcuate wall 85*c* includes a step 85*d* that serves as a first stopper. The projection 85*b* serves as a second stopper.

A stopper or a projection 43*d* projects outwardly from the side wall 43*b* in a direction substantially parallel to the longitudinal axis of the toner cartridge 41. A stopper or projection 43*e* also projects from one end of the bottom surface 43*a*. When the shutter 42 is positioned at the closing position where the shutter 42 closes the discharging opening 44, the projection 85*b* engages the projection 43*e*. When the shutter 42 is rotated in a direction shown by arrow D shown in FIG. 7 to an opening position where the shutter 42 opens the discharging opening 44, the step 85*d* engages the projection 43*d*.

A recess 53 is formed in the body 81 at a position to which the body 81 is rotated from a position in a gravitational direction through 25 degrees approximately. The pin 54 is received in the recess 53 such that the pin 54 is slidable due to gravity in the recess 53. A stopper surface 55 is formed at a position such that the stopper surface 55 faces the recess 53.

The pin 54 has a length such that when the toner cartridge 41 has been attached to the body 37 of the ID unit 16BK and therefore the discharging opening 44 faces downward, the pin 54 is completely received in the recess 53 and will not project outwardly from the recess 53. Thus, the shutter 42 is allowed to rotate between the opening position where the discharging opening 44 is opened and the closing position where the discharging opening 44 is closed.

When the toner cartridge 41 has been detached from the body 37 and the discharging opening 44 faces upward, the pin 54 extends to a first position or an extended position from the recess 53 due to gravity, and abuts the stopper surface 55 as shown in FIGS. 8 and 9.

Thus, when the discharging opening 44 faces upward, if the user operates the operation lever 63 (FIG. 1) in an attempt to cause the shutter 42 to rotate in a direction shown by arrow E (FIG. 9), the pin 54 abuts the projection 51, not allowing the shutter 42 to rotate any further toward the opening position. This prevents the discharging opening 44 from being opened. When the toner cartridge 41 is attached to the body 37, the pin 54 moves out of engagement with the projection 51 allowing the shutter 42 to open or close the discharging opening 44.

As described above, the projection 51 projects from the side wall 43*b* in a direction parallel to a direction in which the case 43 extends, being disposed in the vicinity of the guide portion 43*c* of the case 43. The pin 54 is slidably received in the recess 53 formed in the body 81 of the shutter 42. Thus, when the toner cartridge 41 has been attached to the body 37 of the ID unit 16BK, the pin 54 retracts into the recess 53 so that the pin 54 will move to a second position or retracted position where the pin 54 is out of engagement with the pin 51 to allow the shutter 42 rotate to the opening position. When the toner cartridge 41 has been detached from the body 37 of the ID unit, and is held with the discharging opening 44 facing upward, the pin 54 extends from the recess 53, so that the pin 54 will move into engagement with the pin 51 to prevent the shutter 42 from rotating to the opening position.

This prevents the shutter 42 from being opened inadvertently so that no foreign matter enters the toner cartridge 41.

While the projection 51 is disposed in the vicinity of an upper portion of the guide portion 43*c* in the gravitational direction, the projection may be disposed any position as long as the discharging opening 44 will not open when the pin 54 abuts the projection 51.

Second Embodiment

Elements similar to those of the first embodiment have been given the same reference member.

Figure 10:
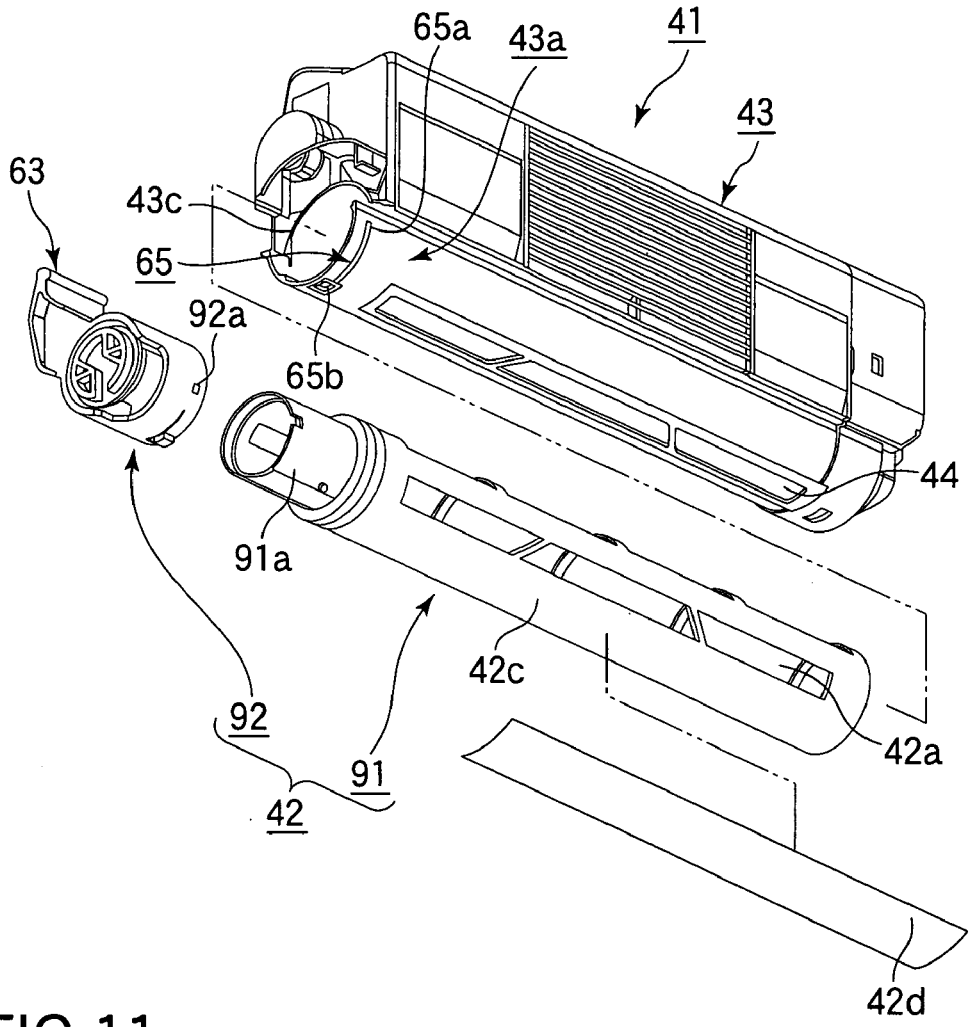
FIG. 10 is a perspective exploded view of a toner cartridge of a second embodiment.
Figure 11:
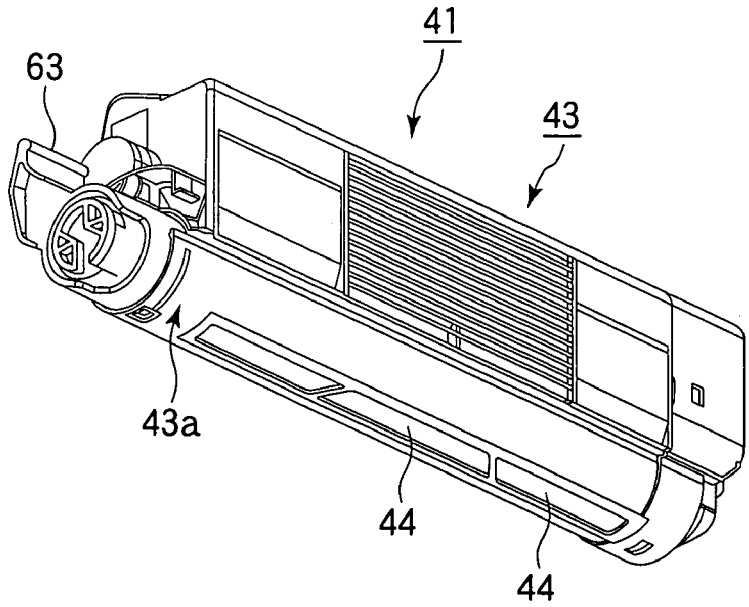
FIG. 11 is a perspective view illustrating the toner cartridge when an operation lever is at a closing position.
Figure 12:
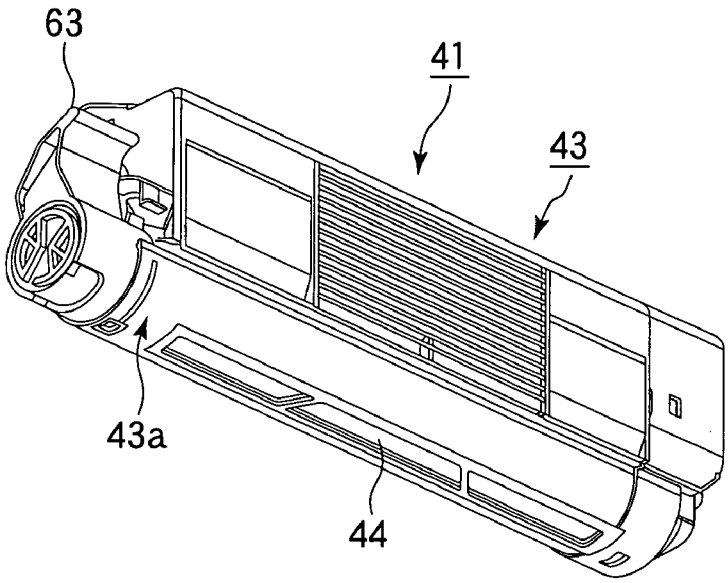
FIG. 12 is a perspective view illustrating the toner cartridge when the operation lever is at an opening position.

FIG. 10 is a perspective exploded view of a toner cartridge 41 of a second embodiment. FIG. 11 illustrates the toner cartridge 41 when an operation lever 63 is at a closing position where a shutter 42 closes a discharging opening 44 of a toner cartridge 41, and FIG. 12 illustrates the toner cartridge 41 when the operation lever 63 is at an opening position where the shutter 42 opens the discharging opening 44 of the toner cartridge 41.

An arcuate groove 65 is formed in the bottom surface 43*a* of the case 43 in the vicinity of one longitudinal end of the case 43. A projection 92*a* is slidable only in the groove 65 so that the knob 92 is prevented from being pulled out of engagement with a first portion or a body 91 of the shutter 42. The projection 92*a* is formed on an outer surface of a second portion or a knob 92, being received in the arcuate groove 65 from inside of the case 43. The groove 65 may also serve as a means for defining an extent in which the knob 92 is rotatable relative to the body 91, and ends 65*a* and 65*b* of the groove 65 serve as stoppers, respectively, that limit the extent in which the shutter 42 is moved when the operation lever 63 is operated.

The toner cartridge 41 includes a case 43 having a bottom surface 43*a* in the shape of a partial cylinder. A discharging opening 44 is formed in the bottom surface 43*a*. The shutter 42 is generally in the shape of a hollow cylinder, and mounted to the bottom surface 43*a*. The shutter 42 is movable to the opening position where the shutter 42 opens the discharging the opening 44, and to the closing position where the shutter 42 closes the discharging opening 44. The shutter 42 includes a shutter portion and an opening 42*a*.

The shutter 42 includes a first portion or a body 91 that extends over the entire length of the case 43, and a second portion or knob 92 that detachably slidably fits over a sliding surface 91*a* formed at one longitudinal end portion of the shutter 42. The knob 92 is selectively locked to the shutter 42 by means of locking member or a pin 69, which will be described later, when the pin 69 moves relative to the shutter and the knob 92.

The body 91 includes the sliding surface 91*a* over which the knob 92 fits, a shutter portion 42*c* that closes the discharging opening 44, and an opening 42*a* that opens the discharging opening 44. An operation lever 63 is in one piece with the knob 92, and extends radially outwardly from the knob 92.

Thus, when the operation lever 63 is operated after the knob 92 has fitted over the body 91, the shutter 42 rotates to open or close the discharging opening 44.

Figure 13:
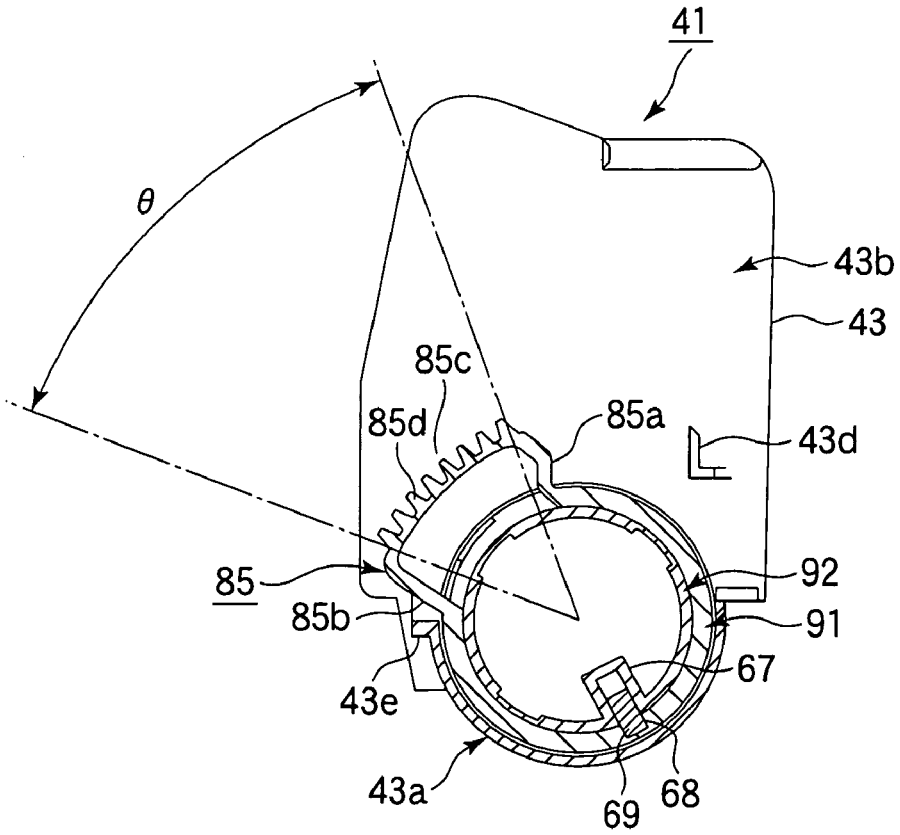
FIGS. 13 and 14 are a first cross-sectional view and a second cross-sectional view, respectively, illustrating a pertinent portion of the toner cartridge when the toner cartridge has been attached to a body of an ID unit.
Figure 14:
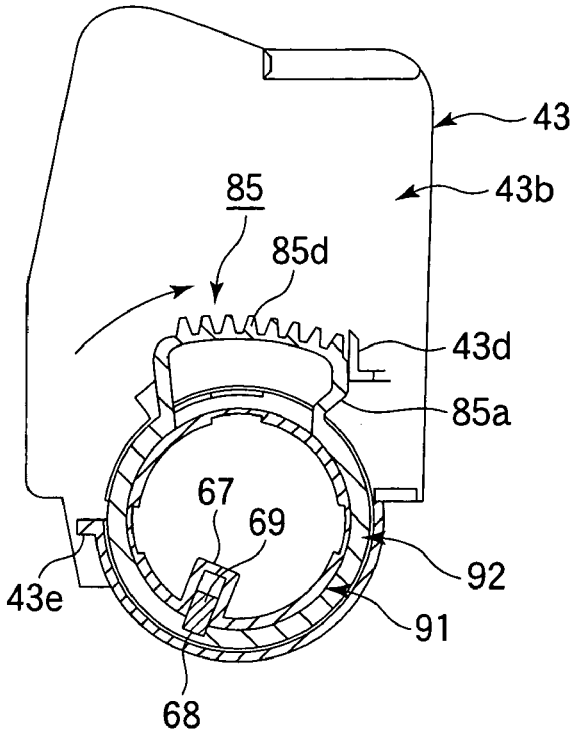

FIGS. 13 and 14 are a first cross-sectional view and a second cross-sectional view, respectively, illustrating a pertinent portion of the toner cartridge 41 when the toner cartridge 41 has been attached to a body 37 of an ID unit 16BK.

FIG. 13 illustrates a radial extension 85 when it is at the closing position. When the radial extension 85 is at the closing position, a projection 85*b* abuts a stopper or a projection 43*e*. FIG. 14 illustrates the radial extension 85 when it is at the opening position. When the radial extension is at the closing position, a projection 85*a* abuts a stopper or a projection 43*d*.

The short cylindrical portion 92 includes the radial extension 85. The radial extension 85 includes the projections 85*a* and 85*b* extending from the short cylindrical portion 92 in a substantially radial direction. An arcuate wall 85*c* extends across the projections 85*a* and 85*b* across a predetermined angular range θ (FIG. 13) with respect to the rotational axis of the shutter 42. The radial extension 85 defines angular range in which the shutter 42 may rotate. When the user operates the operation lever 63, the shutter 42 rotates within the angular range.

The projection 43*d* projects outwardly from the side wall 43*b* in a direction substantially parallel to the longitudinal axis of the toner cartridge 41. A projection 43*e* also projects from one end of the bottom surface 43*a*. The projections 43*d* and 43*e* serve as a second engagement element. When the shutter 42 is positioned at the closing position, the projection 85*b* engages the projection 43*e*. When the shutter 42 is rotated in a direction shown by arrow D shown in FIG. 7 to a position where the shutter 42 opens the discharging opening 44, the step 85*d* engages the projection 43*d*.

A recess 67 extends a predetermined length in a radial direction inside of the body 91. A locking element or the pin 69 is received in the recess 67 such that the pin 69 is slidable due to gravity in the recess 67. A stopper surface 55 is formed at a position where the stopper surface 55 faces the recess 67 when the shutter 42 closes the discharging opening 44 of the toner cartridge 41. The knob 92 includes a stopper or a recess 68 formed in an inner surface of the knob 92, and is configured to receive a part of the pin 69 therein.

The recess 68 is formed at a position such that when the lever 63 is at the closing position and the body 91 is at a rotational position where the shutter closes the discharging opening 44, the recess 68 is in alignment with the recess 67.

When the toner cartridge 41 is mounted to the body 37 such that the discharging opening 44 faces downward, the pin 69 extends to a first position or an extended position from the recess 67 as shown in FIGS. 13 and 14 due to gravity to enter the recess 68, so that the knob 92 and the body 91 are locked to each other by means of the pin 69. The locking engagement of the knob 92 and the body 91 allows the shutter 42 to move either to the opening position where the discharging opening 44 is opened or to the closing position where the discharging opening 44 is closed.

Figure 15:
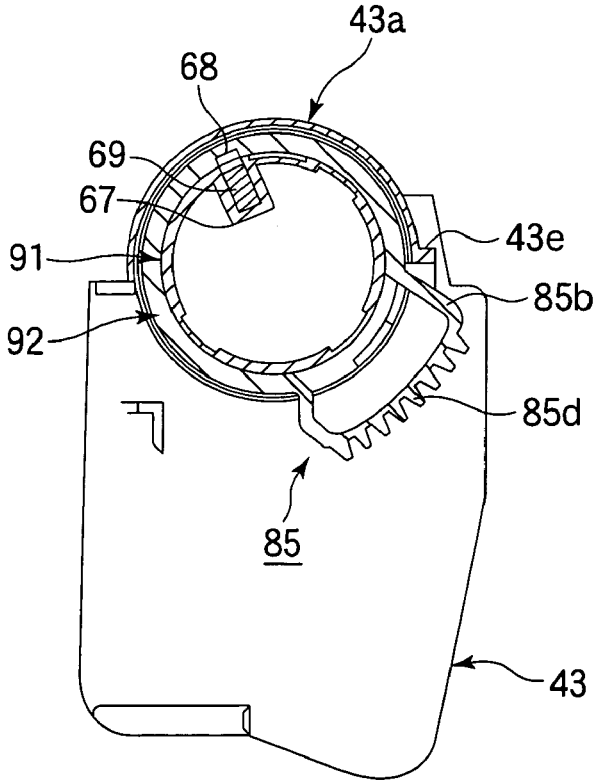
FIGS. 15 and 16 are a first cross-sectional view and a second cross-sectional view, respectively, illustrating a pertinent portion of the toner cartridge when the toner cartridge has been detached from the body of the ID unit.
Figure 16:
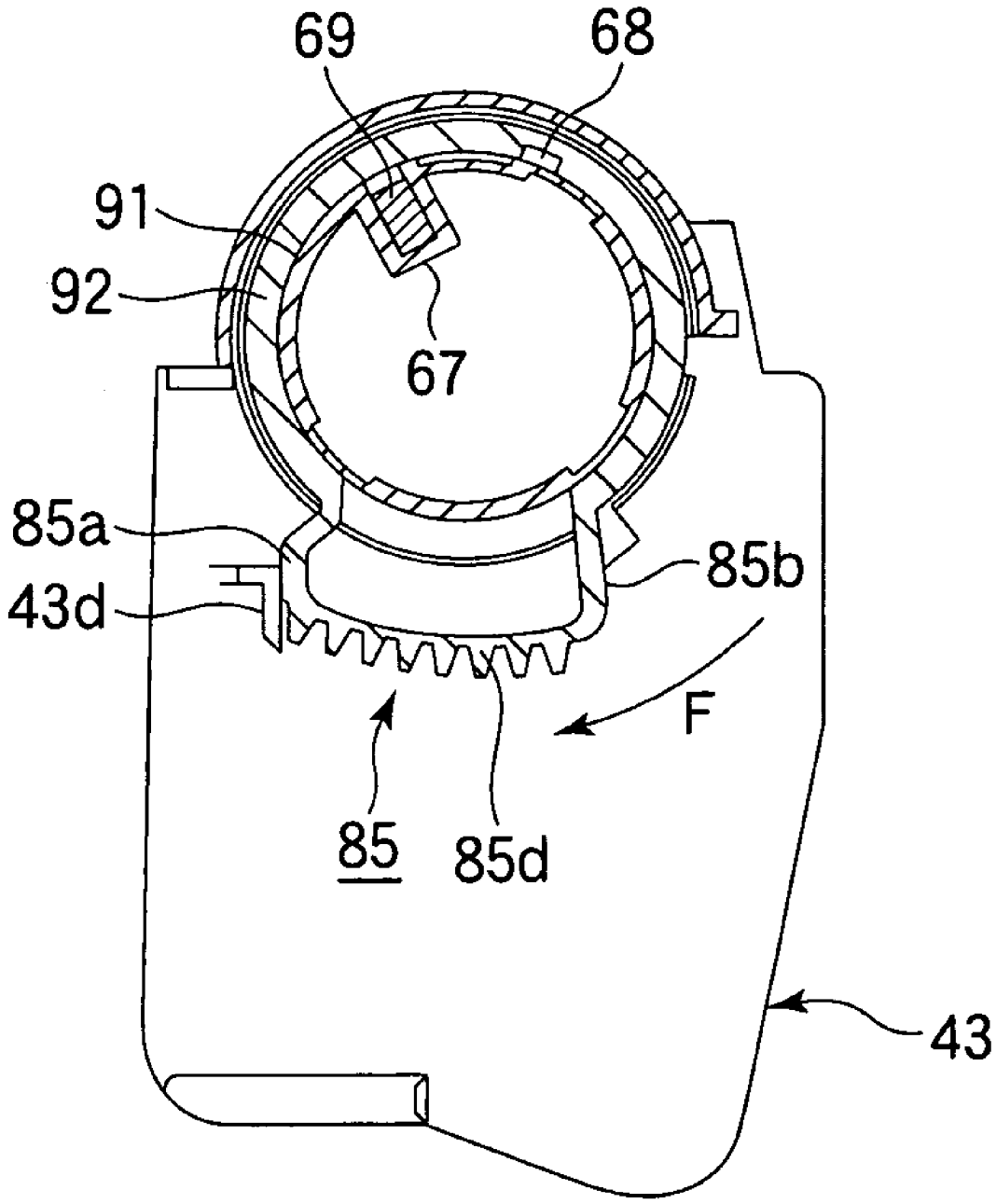

FIGS. 15 and 16 are a first cross-sectional view and a second cross-sectional view, respectively, illustrating a pertinent portion of the toner cartridge 41 when the toner cartridge 41 has been detached from the body 37.

Referring to FIGS. 15 and 16, when the toner cartridge 41 is oriented such that the discharging opening 44 faces upward after the toner cartridge 41 has been detached from the body 37, the pin 69 retracts to a second position or a retracted position into the recess 67 as shown in FIGS. 15 and 16, so that the knob 92 and the body 91 are unlocked from each other. The pin 69 has a length such that once the pin 69 has retracted into the recess 67, the pin 69 is completely in the recess the recess 67.

The pin 69, recess 67, and recess 68 are related as follows:

$$D1<L<D2$$

where L is the length of the pin 69, D1 is the depth of the recess 68, and D2 is the depth of the recess 67.

As described above, when the toner cartridge 41 is oriented such that the discharging opening 44 faces upward, the pin 69 is out of engagement with the recess 68. Thus, if the user operates the operation lever 63 to rotate the shutter 42 in a direction of arrow F from the FIG. 15 position to the FIG. 16 position, only the knob 92 is allowed to rotate and the body 91 is not allowed to rotate. This prevents the shutter 42 from rotating so that the discharging opening 44 remains closed.

While the first and second embodiments have been described in term of the operation lever 63 formed in one piece with the knob 82 or 92, the operation lever 63 may be a component separate from the knob 82 or 92 and coupled by means of a coupling member.

Although the embodiments have been described in terms of a printer, the invention may be applied to, for example, copying machines, facsimile machines, and multi-function peripherals (MFPs).

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. A powder developer holding apparatus comprising:

a housing that holds powder developer, said housing including a discharging opening through which the powder developer is discharged;

a shutter mounted to said housing, said shutter being rotatable relative to said housing to an opening position where the discharging opening is opened or to a closing position where the discharging opening is closed;

a locking member slidably mounted to said shutter, wherein when the powder developer holding apparatus is oriented such that the discharging opening faces upward in a gravitational direction, said locking member slides due to gravity relative to said shutter to a position where said locking member prevents said shutter from rotating relative to said housing.

2. The powder developer holding apparatus according to claim 1, wherein said housing includes a stopper formed thereon, wherein when the powder developer holding apparatus is oriented such that the discharging opening faces upward, said locking member slides relative to said housing to the position where when said shutter is rotated relative to said housing, said locking member engages the stopper preventing said shutter from rotating to the opening position.

3. The powder developer holding apparatus according to claim 2, wherein the position is a first position, wherein when the powder developer holding apparatus is oriented such that the discharging opening faces downward, said locking member slides relative to said shutter to a second position where when said shutter is rotated relative to said housing, said locking member remains in said shutter so that the stopper allows said shutter to rotate to the opening position.

4. The powder developer holding apparatus according to claim 1, wherein the position is a first position and said housing includes a stopper formed thereon, wherein when the powder developer holding apparatus is oriented such that the discharging opening faces downward, said locking member slides relative to said shutter to a second position where when said shutter is rotated relative to said housing, said locking member remains in said shutter so that the stopper allows said shutter to rotate to the opening position.

5. The powder developer holding apparatus according to claim 1, wherein said shutter includes a first portion, a second portion that slidably fits over the first portion, and a stopper formed in said shutter;

wherein when the powder developer holding apparatus is oriented such that the discharging opening faces upward, said locking member slides relative to said housing to the position where when the second portion is rotated relative to said housing, said locking member remains in said shutter so that the stopper prevents said shutter from rotating to the opening position.

6. The powder developer holding apparatus according to claim 5, wherein the position is a first position and said shutter includes a first portion, a second portion that slidably fits over the first portion, and a stopper formed in said shutter;

wherein when the powder developer holding apparatus is oriented such that the discharging opening faces downward, said locking member slides relative to said shutter to a second position where when the second portion is rotated relative to said housing, said locking member engages the stopper allowing said shutter to rotate to the opening position.

7. The powder developer holding apparatus according to claim 1, wherein the position is a first position and said shutter includes a first portion, a second portion that slidably fits over the first portion, and a stopper formed in said shutter;

wherein when the powder developer holding apparatus is oriented such that the discharging opening faces downward, said locking member slides relative to said shutter to a second position where when the second portion is rotated relative to said housing, said locking member engages the stopper allowing said shutter to rotate to the opening position.

8. The powder developer holding apparatus according to claim 1, wherein said shutter includes an operation lever;

wherein when the operation lever is operated by an operator, said shutter is caused to rotate to either the opening position or to the closing position.

9. A developing apparatus incorporating the powder developer holding apparatus according to claim 1.

10. A developing apparatus incorporating the powder developer holding apparatus according to claim 2.

11. A developing apparatus incorporating the powder developer holding apparatus according to claim 3.

12. A developing apparatus incorporating the powder developer holding apparatus according to claim 4.

13. An image forming apparatus incorporating the powder developer holding apparatus according to claim 1.

* * * * *